US011559992B2

(12) United States Patent
Nakagawa et al.

(10) Patent No.: US 11,559,992 B2
(45) Date of Patent: Jan. 24, 2023

(54) INKJET PRINTING APPARATUS AND DETERMINING METHOD

(71) Applicant: CANON KABUSHIKI KAISHA, Tokyo (JP)

(72) Inventors: Yoshinori Nakagawa, Kawasaki (JP); Takatoshi Nakano, Yokohama (JP); Atsushi Takahashi, Tama (JP); Takuya Fukasawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/564,463

(22) Filed: Sep. 9, 2019

(65) Prior Publication Data

US 2020/0108616 A1 Apr. 9, 2020

(30) Foreign Application Priority Data

Oct. 5, 2018 (JP) ..... JP2018-189619

(51) Int. Cl.
*B41J 2/165* (2006.01)
*B41J 2/17* (2006.01)
(Continued)

(52) U.S. Cl.
CPC ..... *B41J 2/1721* (2013.01); *B41J 2/16523* (2013.01); *B41J 2/17566* (2013.01);
(Continued)

(58) Field of Classification Search
None
See application file for complete search history.

(56) References Cited

U.S. PATENT DOCUMENTS 6,357,854 B1 * 3/2002 Igval ..... B41J 2/16523 347/29
6,984,009 B2 1/2006 Nakagawa et al.
(Continued)

FOREIGN PATENT DOCUMENTS

JP 2005-53125 A 3/2005
JP 2005053125 A * 3/2005
JP 2011083896 A * 4/2011

OTHER PUBLICATIONS

Do, Yoshimitsu, Printer and Waste Management Device, Mar. 3, 2005, Japan, All Pages (Year: 2005).*

*Primary Examiner* — Erica S Lin
*Assistant Examiner* — Tracey M McMillion
(74) *Attorney, Agent, or Firm* — Venable LLP

(57) ABSTRACT

An inkjet printing apparatus includes a print head that ejects ink, a waste ink tank having an absorber that absorbs ink discharged from the print head. The inkjet printing apparatus further includes a counting unit that counts a waste ink amount discharged to the waste ink tank, a timer that measures an elapsed time from installation of the waste ink tank in the apparatus, an acquiring unit that acquires a waste ink retention amount by obtaining an evaporation amount from evaporation of waste ink retained in the waste ink tank based on the elapsed time and subtracting the evaporation amount from the waste ink amount, a notifying unit that notifies that the waste ink retention amount exceeds a threshold; and a setting unit that sets the threshold based on a waste ink evaporation rate calculated by using the evaporation amount and the waste ink amount.

3 Claims, 19 Drawing Sheets

(51) Int. Cl.
*B41J 2/175* (2006.01)
*B41J 2/185* (2006.01)

(52) U.S. Cl.
CPC ..... *B41J 2/185* (2013.01); *B41J 2002/1728* (2013.01); *B41J 2002/1742* (2013.01)

(56) References Cited

U.S. PATENT DOCUMENTS

| | | | |
|---|---|---|---|
| 6,994,416 | B2 | 2/2006 | Seki et al. |
| 7,144,096 | B2 | 12/2006 | Seki et al. |
| 7,396,095 | B2 | 7/2008 | Nakagawa et al. |
| 7,896,463 | B2 | 3/2011 | Nakagawa et al. |
| 8,752,930 | B2 | 6/2014 | Doi et al. |
| 8,827,419 | B2 | 9/2014 | Nakagawa et al. |
| 8,944,562 | B2 | 2/2015 | Nakagawa et al. |
| 9,096,065 | B2 | 8/2015 | Nakano et al. |
| 9,862,195 | B2 | 1/2018 | Genta et al. |
| 10,265,951 | B2 | 4/2019 | Nakano et al. |
| 10,286,657 | B2 | 5/2019 | Kameshima et al. |
| 10,369,797 | B2 | 8/2019 | Genta et al. |
| 10,427,410 | B2 | 10/2019 | Nakagawa et al. |
| 10,442,191 | B2 | 10/2019 | Takahashi et al. |
| 10,493,762 | B2 | 12/2019 | Sato et al. |
| 2004/0041862 | A1 | 3/2004 | Nakagawa et al. |
| 2006/0087539 | A1* | 4/2006 | Loyd ..... B41J 2/195 347/7 |
| 2013/0100200 | A1 | 4/2013 | Hamasaki et al. |
| 2016/0052309 | A1* | 2/2016 | Taguchi ..... B41J 13/0045 347/16 |
| 2018/0154630 | A1* | 6/2018 | Takahashi ..... B41J 2/04551 |
| 2019/0001670 | A1 | 1/2019 | Fukasawa et al. |
| 2019/0009522 | A1 | 1/2019 | Fukasawa et al. |
| 2019/0009553 | A1 | 1/2019 | Nakai et al. |
| 2019/0009590 | A1 | 1/2019 | Fukasawa et al. |
| 2019/0154630 | A1* | 5/2019 | Cobianu ..... H01L 29/66977 |
| 2020/0108610 | A1 | 4/2020 | Kiuchi et al. |
| 2020/0108611 | A1 | 4/2020 | Nakagawa et al. |
| 2020/0108612 | A1 | 4/2020 | Nakagawa et al. |
| 2020/0108626 | A1 | 4/2020 | Fukasawa et al. |

* cited by examiner

| WASTE INK EVAPORATION AMOUNT Ea (mg/hrs.) | | TEMPERATURE t | |
|---|---|---|---|
| | | LOWER THAN 23℃ | EQUAL TO OR HIGHER THAN 23℃ |
| HUMIDITY h | LOWER THAN 50% | 14.2 | 14.8 |
| | EQUAL TO OR HIGHER THAN 50% | 7.9 | 8.2 |

FIG.14

| | WASTE INK EVAPORATION RATE Ep1 | |
|---|---|---|
| | LOWER THAN 50% | EQUAL TO OR HIGHER THAN 50% |
| WASTE INK ERROR THRESHOLD H | 650g | 550g |

FIG.17

| WASTE INK ERROR THRESHOLD H | WASTE INK EVAPORATION RATE Ep1 | |
|---|---|---|
| | LOWER THAN 50% | EQUAL TO OR HIGHER THAN 50% |
| RATIO OF BLACK INK, LOWER THAN 70% | 650g | 600g |
| RATIO OF BLACK INK, EQUAL TO OR HIGHER THAN 70% | 650g | 550g |

FIG.18

| WASTE INK ERROR THRESHOLD H | | WASTE INK EVAPORATION RATE Ep1 | |
|---|---|---|---|
| | | LOWER THAN 50% | EQUAL TO OR HIGHER THAN 50% |
| INK DENSITY D | LESS THAN 0.0632 | 650g | 550g |
| | EQUAL TO OR GREATER THAN 0.0632 | 600g | 500g |

FIG.19

INKJET PRINTING APPARATUS AND DETERMINING METHOD

BACKGROUND OF THE INVENTION

Field of the Invention

The present invention relates to an inkjet printing apparatus that prints an image by ejecting ink and a method for determining an error in a waste ink tank provided in the inkjet printing apparatus.

Description of the Related Art

Some inkjet printing apparatuses determine the full capacity of a waste ink tank based on a count value of a waste ink amount discharged to the waste ink tank and notify the full capacity to a user. At this time, since ink held in the waste ink tank evaporates as time passes, a total amount of the waste ink that can be held in the waste ink tank changes depending on the amount of ink that has evaporated.

Japanese Patent Laid-Open No. 2005-53125 discloses a method for determining the full capacity of a waste ink tank based on an obtained value, the method including estimating an evaporation amount of waste ink based on the time elapsed from the discharge of the waste ink and obtaining the value by subtracting the estimated evaporation amount from a total amount of the waste ink.

However, depending on the components of ink used in the printing apparatus and the material of an absorber housed inside the waste ink tank, the waste ink may thicken and adhere inside the absorber, thereby preventing subsequently discharged waste ink from diffusing. In this case, even if the total amount of discharged waste ink has not reached the amount corresponding to the full capacity of the waste ink tank, the absorber may not be able to hold the waste ink any further, causing the waste ink to spill over the waste ink tank.

SUMMARY OF THE INVENTION

The present invention has been made to solve the above problem. Accordingly, an object of the present invention is to provide an inkjet printing apparatus capable of properly detecting a waste ink error.

In a first aspect of the present invention, there is provided an inkjet printing apparatus comprising: a print head that ejects ink; a waste ink tank having an absorber that absorbs ink discharged from the print head; a counting unit configured to count a waste ink amount discharged to the waste ink tank; a timer that measures an elapsed time from installation of the waste ink tank in the apparatus; an acquiring unit configured to acquire a waste ink retention amount by obtaining an evaporation amount of waste ink retained in the waste ink tank based on the elapsed time and subtracting the evaporation amount from the waste ink amount; a notifying unit configured to notify that the waste ink retention amount exceeds a threshold; and a setting unit configured to set the threshold based on a waste ink evaporation rate calculated by using the evaporation amount and the waste ink amount.

In a second aspect of the present invention, there is provided a determining method of an inkjet printing apparatus that includes a print head that ejects ink, and a waste ink tank having an absorber that absorbs ink discharged from the print head, the determining method comprising: counting a waste ink amount discharged to the waste ink tank; measuring an elapsed time from installation of the waste ink tank in the apparatus; acquiring a waste ink retention amount by obtaining an evaporation amount from evaporation of waste ink retained in the waste ink tank based on the elapsed time and subtracting the evaporation amount from the waste ink amount; notifying that the waste ink retention amount exceeds a threshold; and setting the threshold based on a waste ink evaporation rate calculated by using the evaporation amount and the waste ink amount.

Further features of the present invention will become apparent from the following description of exemplary embodiments with reference to the attached drawings.

BRIEF DESCRIPTION OF THE DRAWINGS

FIG. 14 is a table showing a waste ink evaporation amount per unit time;

FIG. 17 is a table for setting a waste ink error threshold;

FIG. 18 is a table for setting a waste ink error threshold; and

FIG. 19 is a table for setting a waste ink error threshold.

DESCRIPTION OF THE EMBODIMENTS

Figure 1:
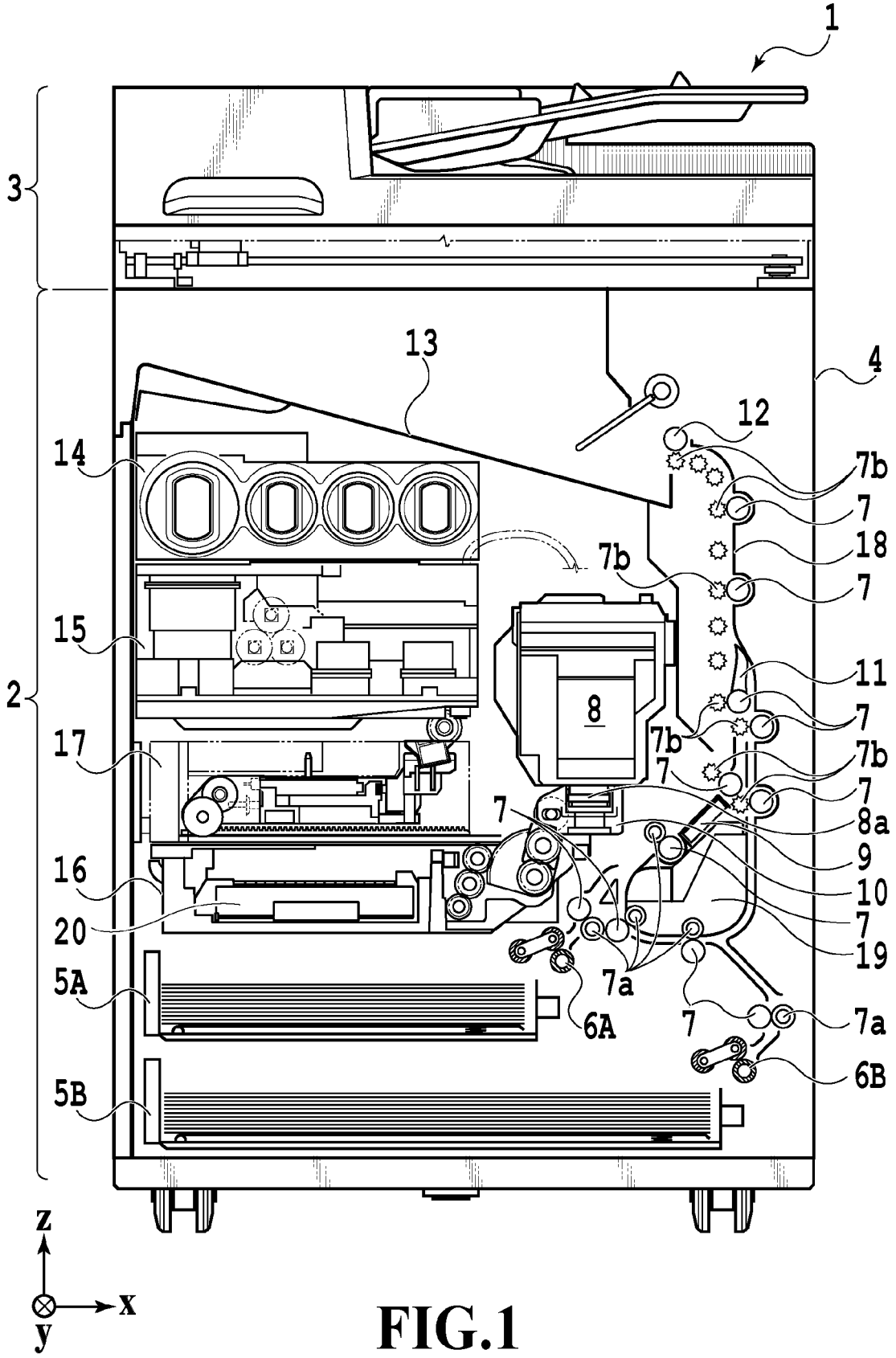
FIG. 1 is a diagram of a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing print media (cut sheets) S are detachably provided at the bottom of a casing 4 in the vertical direction. Relatively small print media of up to A4 size are stacked and housed in the first cassette 5A and relatively large print media of up to A3 size are stacked and housed in the second cassette 5B. A first feeding unit 6A for feeding the housed print media one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing print media S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head 8 is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. Ink discharged from the print head 8 through maintenance operation is collected in a waste ink tank 20 as waste ink. The waste ink tank 20 is installed by being inserted into the inkjet printing apparatus 1 from the front side of the inkjet printing apparatus 1 in the y-direction. A user can remove the waste ink tank 20 that has reached its full capacity (a waste ink amount equal to or greater than a predetermined amount) from the apparatus body and replace it with a new waste ink tank 20. The maintenance operation and the waste ink tank 20 will be described later in detail.

Figure 2:
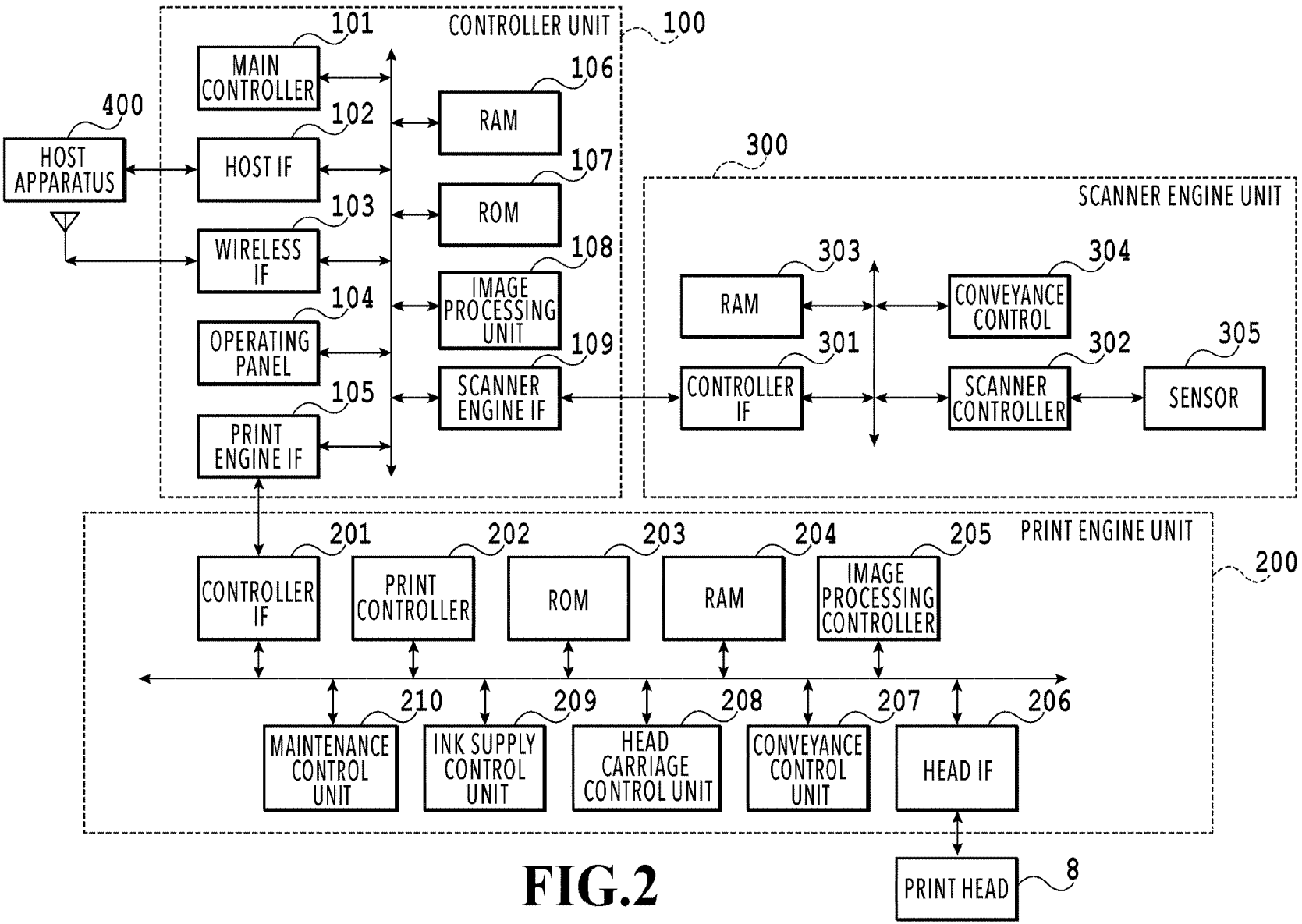
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8. Furthermore, the maintenance unit 16 has a timer for managing a timing at which the maintenance operation is performed and for measuring an elapsed time from the installation of a new waste ink tank 20.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
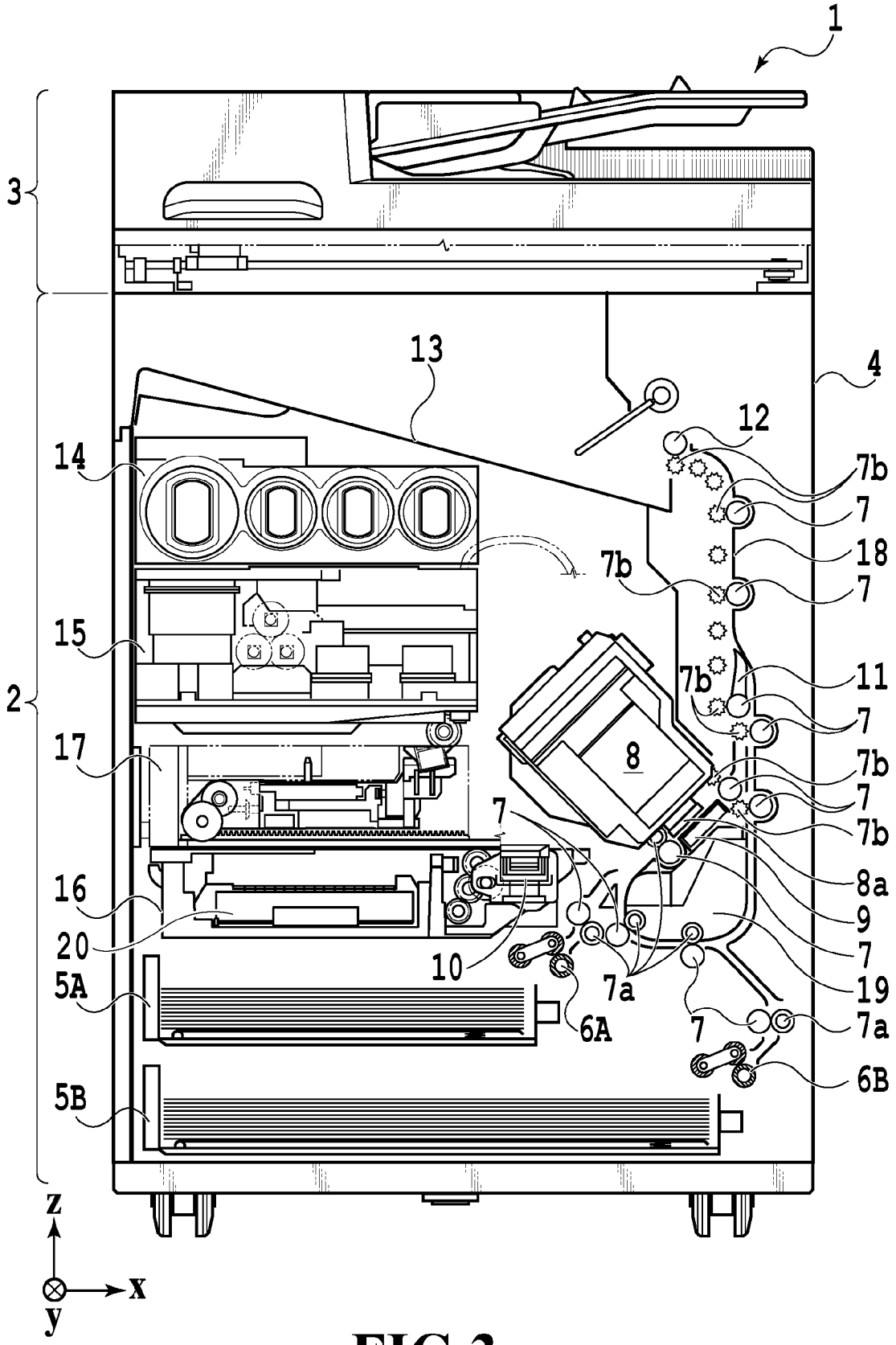
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
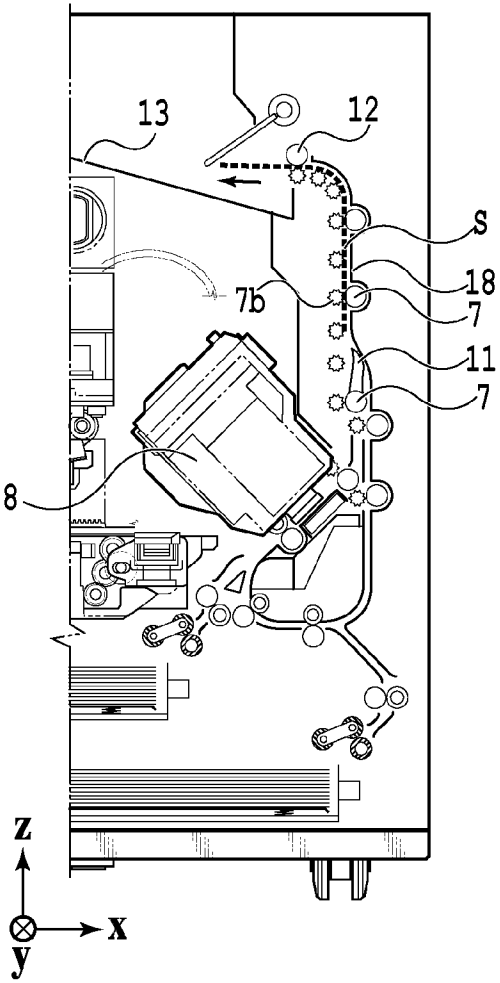
FIGS. 4A to 4C are conveying path diagrams of a print medium fed from a first cassette.
Figure 4B:
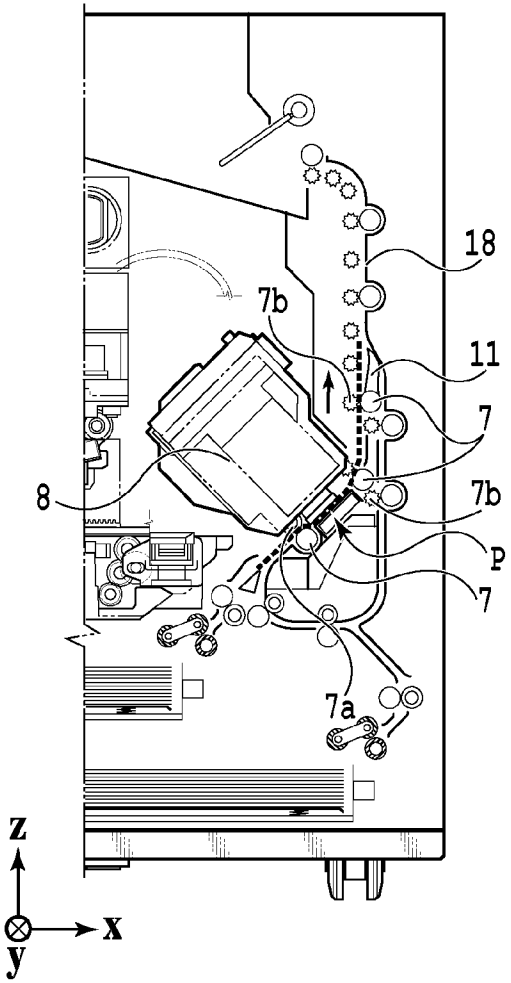
Figure 4A:
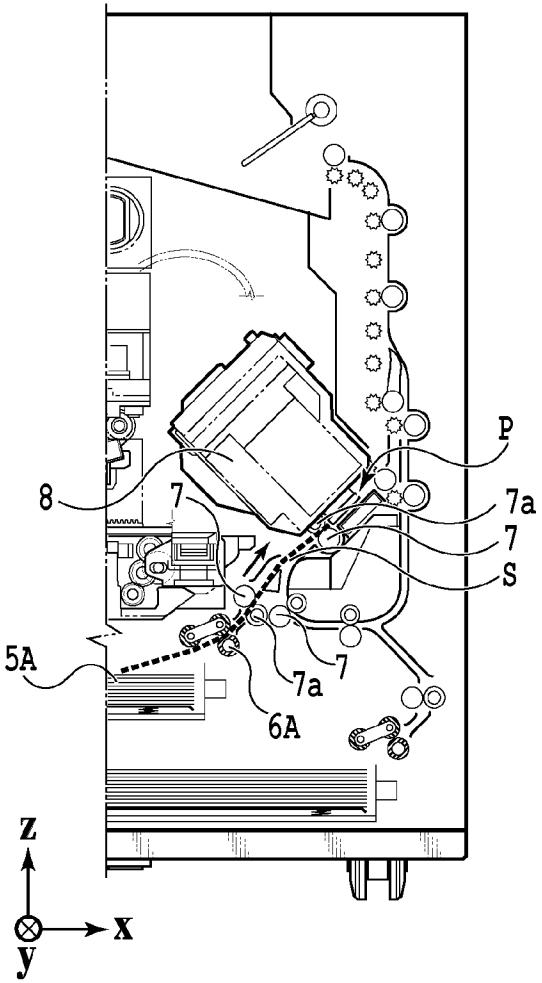

FIGS. 4A to 4C are diagrams showing a conveying path in the case of feeding an A4 size print medium S from the first cassette 5A. A print medium S at the top of a stack of print media in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal plane while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal plane in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
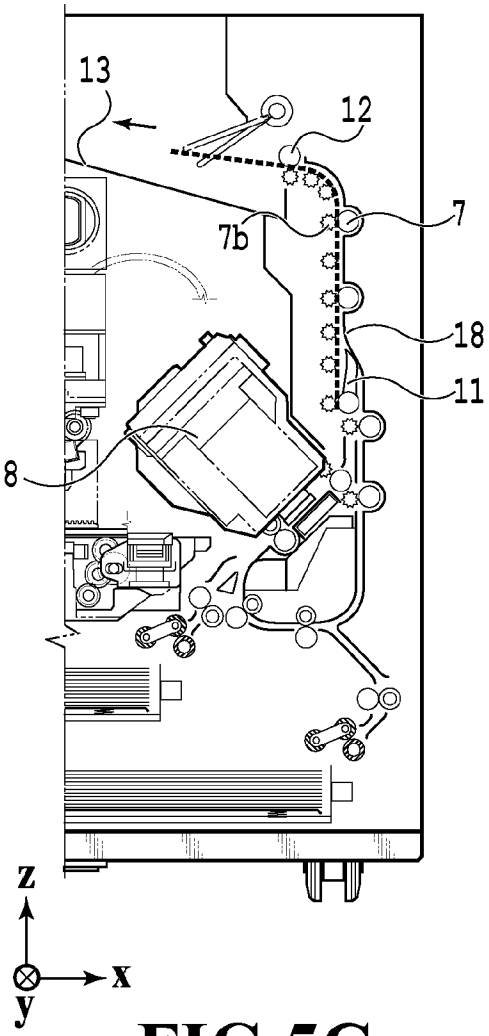
FIGS. 5A to 5C are conveying path diagrams of a print medium fed from a second cassette.
Figure 5B:
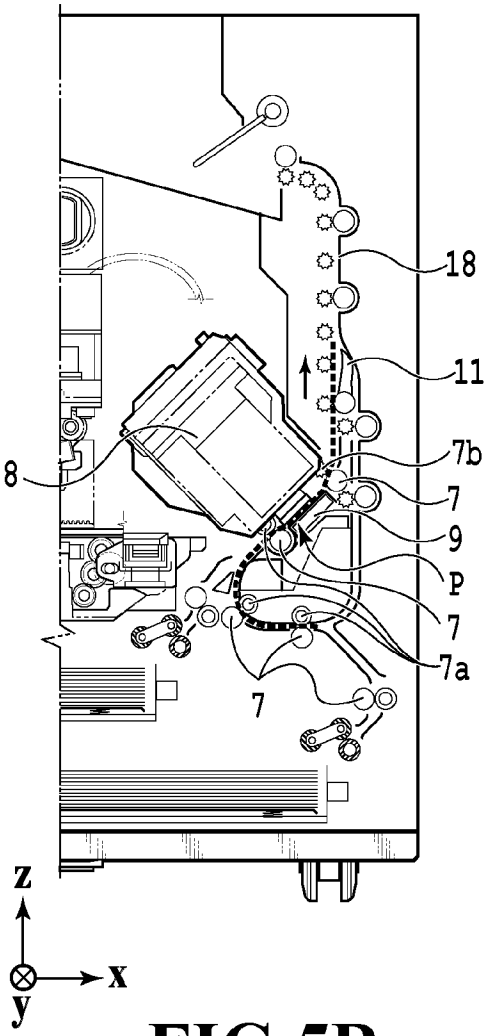
Figure 5A:
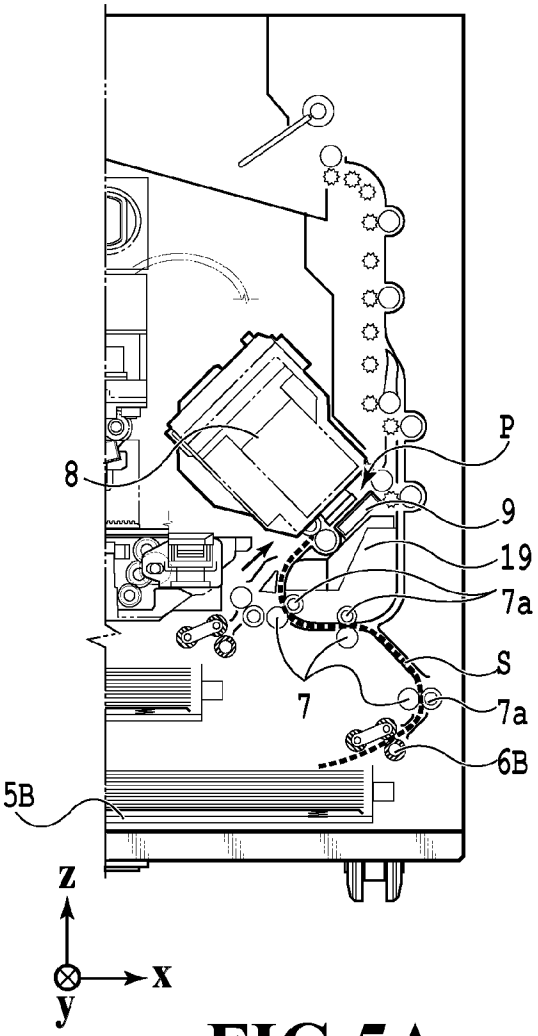

FIGS. 5A to 5C are diagrams showing a conveying path in the case of feeding an A3 size print medium S from the second cassette 5B. A print medium S at the top of a stack of print media in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
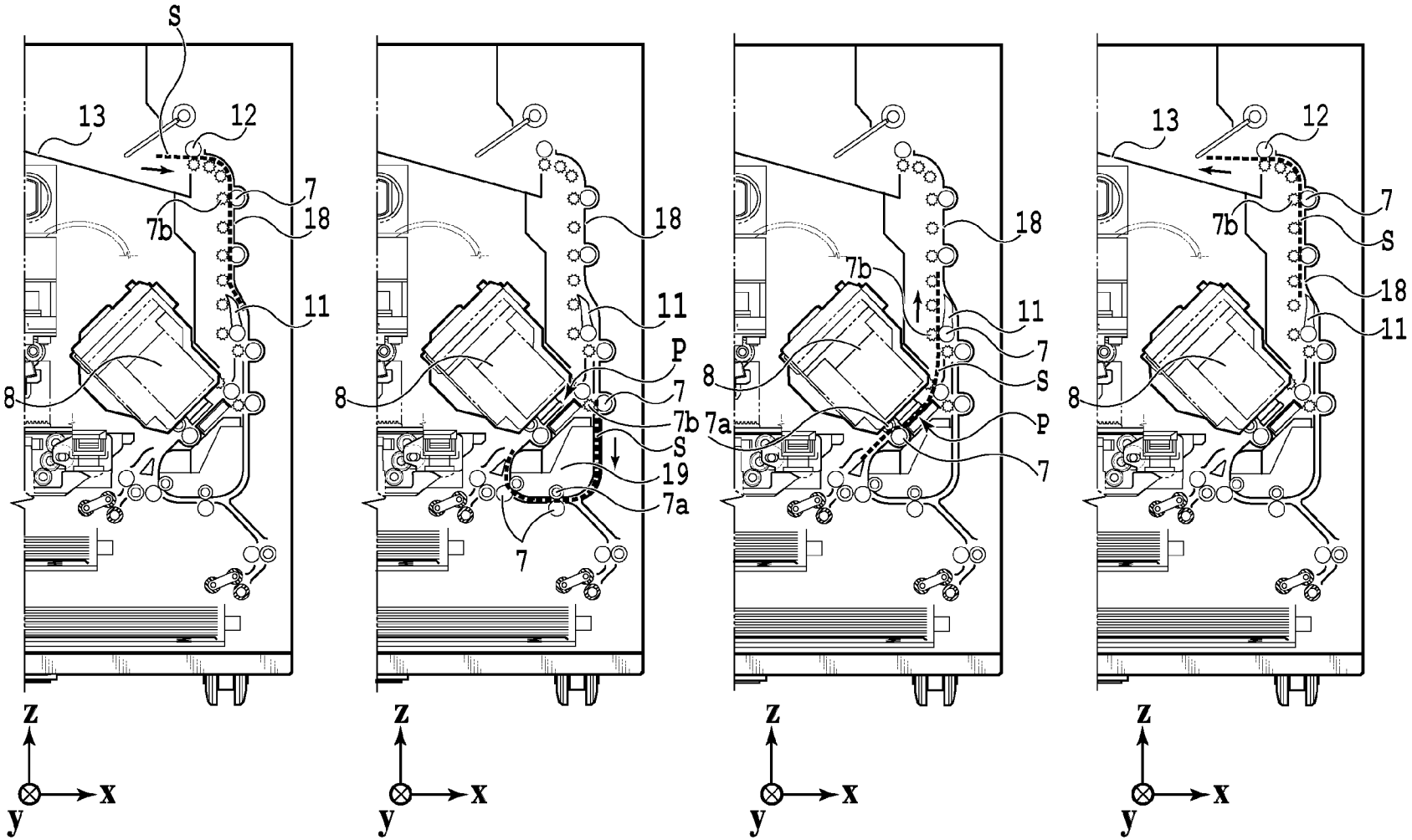
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
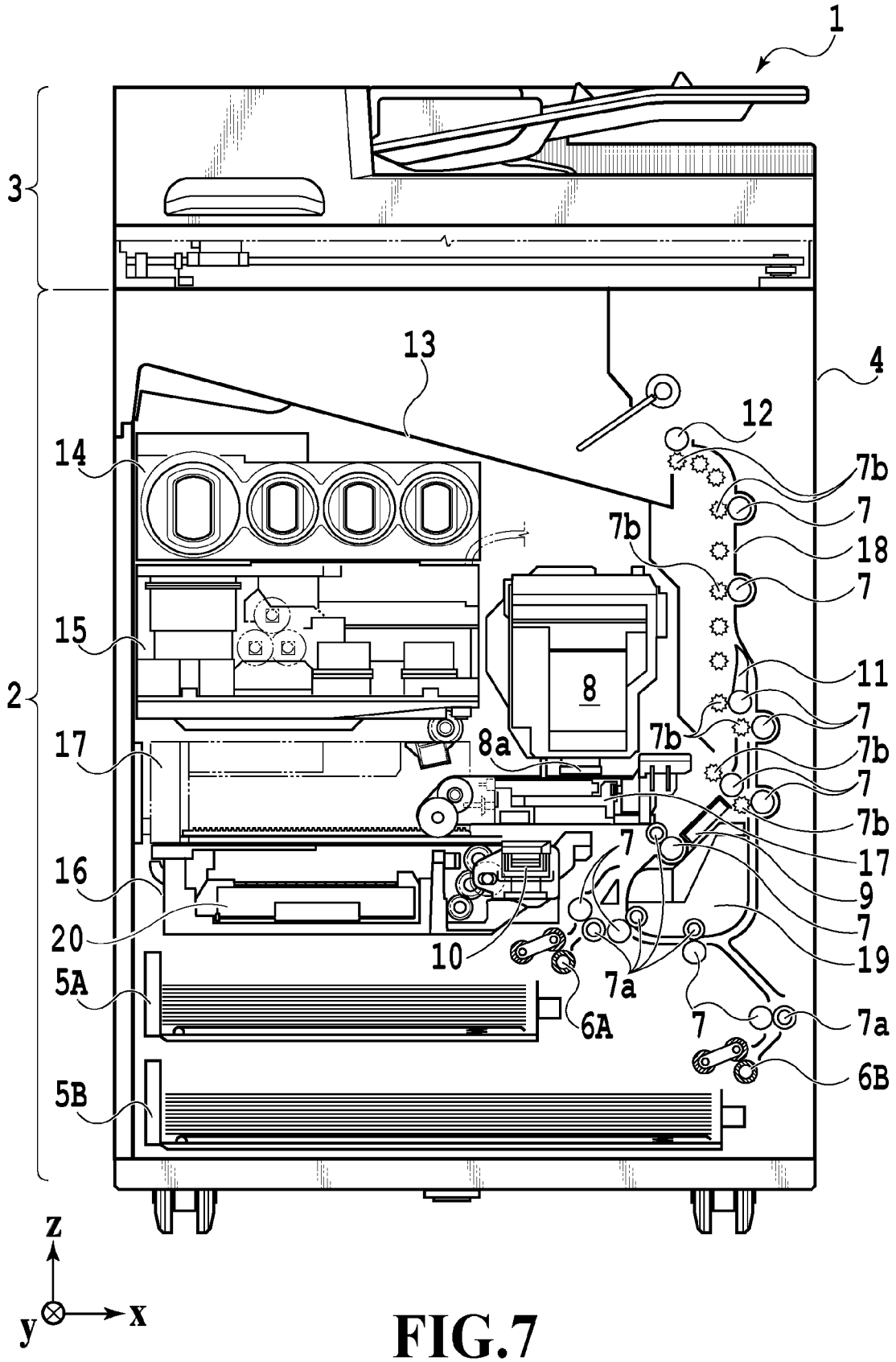
FIG. 7 is a diagram of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
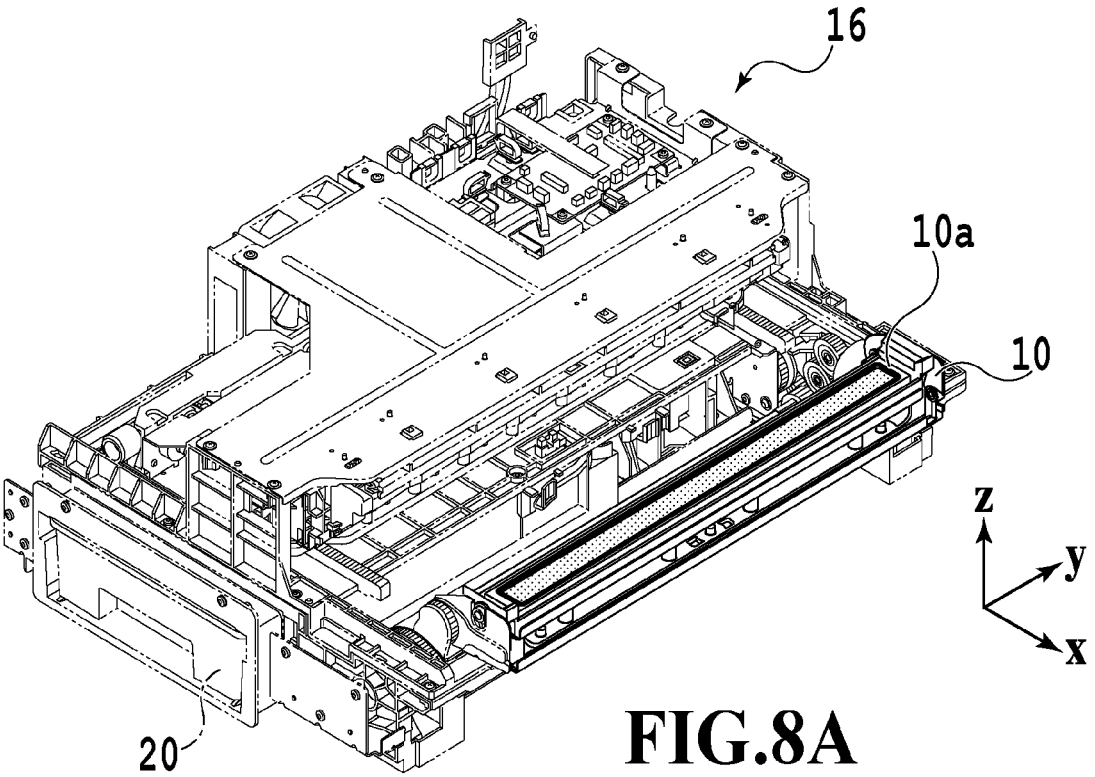
FIGS. 8A and 8B are perspective views showing the configuration of a maintenance unit.
Figure 8B:
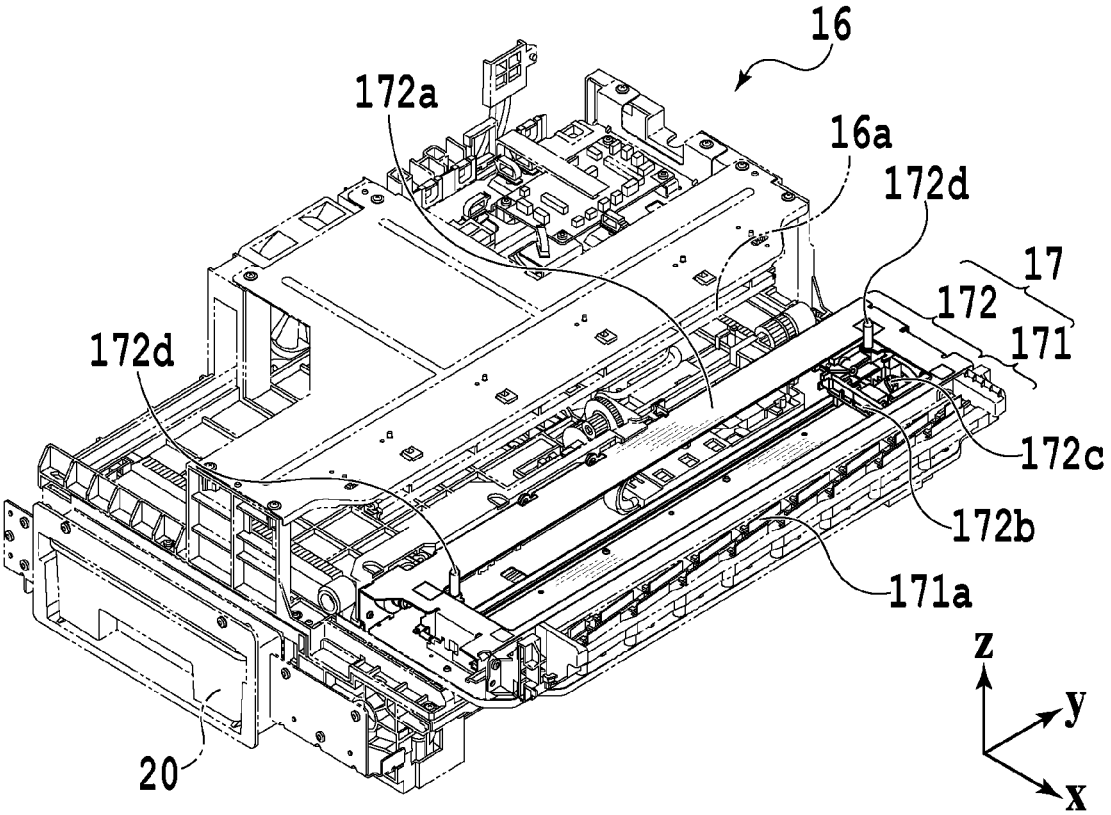

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction along the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member 10*a* and suction operation of collected ink in the same manner as the first wiping process.

The ink sucked by the suction pump is collected in the waste ink tank 20 placed in the maintenance unit 16 via a tube (not shown).

Figure 9:
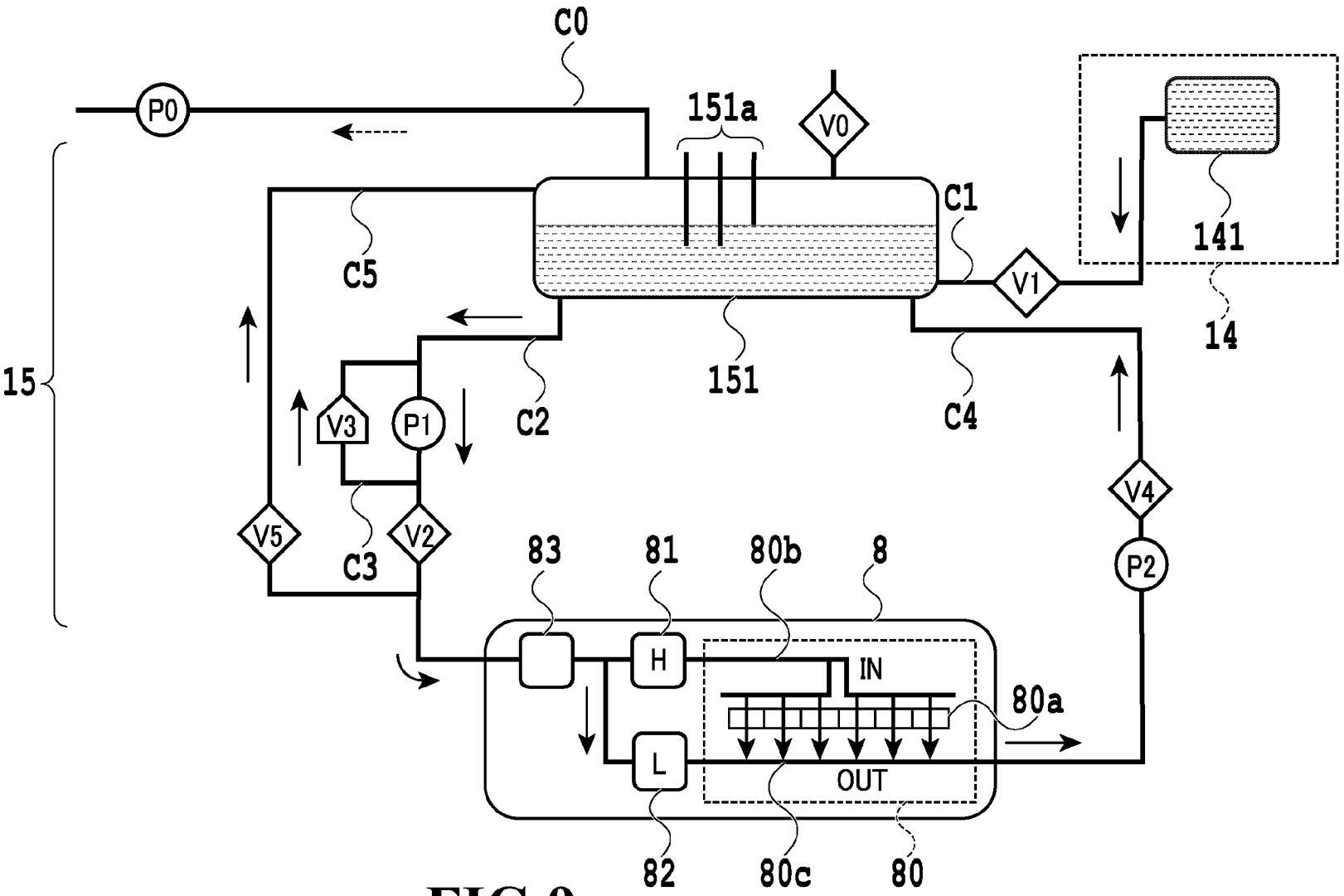
FIG. 9 is a diagram showing an ink supply system.

FIG. 9 is a diagram showing an ink supply system including the ink supply unit 15 adopted in the inkjet printing apparatus 1. The ink supply unit 15 supplies ink supplied from the ink tank unit 14 to the print head 8 (head unit). FIG. 9 shows a configuration of one color of ink, but such a configuration is practically prepared for each color of ink. The ink supply unit 15 is basically controlled by the ink supply control unit 209 shown in FIG. 2.

Ink circulates mainly between a sub-tank 151 and the print head 8. In the print head 8, ink ejection operation is performed based on image data and ink that has not been ejected is collected again in the sub-tank 151.

The sub-tank 151 in which a certain amount of ink is contained is connected to a supply flow path C2 for supplying ink to the print head 8 and to a collection flow path C4 for collecting ink from the print head 8. In other words, a circulation flow path (circulation path) for circulating ink is composed of the sub-tank 151, the supply flow path C2, the print head 8, and the collection flow path C4. Furthermore, the sub-tank 151 is connected to a flow path C0 in which air flows.

In the sub-tank 151, a liquid level detection unit 151*a* composed of a plurality of electrode pins is provided. The ink supply control unit 209 detects presence/absence of a conducting current between those pins so as to grasp a height of an ink liquid level, that is, an amount of remaining ink inside the sub-tank 151. A vacuum pump P0 (in-tank vacuum pump) is a negative pressure generating source for reducing pressure inside the sub-tank 151. An atmosphere release valve V0 is a valve for switching between whether or not to make the inside of the sub-tank 151 communicate with atmosphere.

A main tank 141 is a tank that contains ink which is to be supplied to the sub-tank 151. The main tank 141 has a configuration removable from the printing apparatus body. In the midstream of a tank connection flow path C1 connecting the sub-tank 151 and the main tank 141, a tank supply valve V1 for switching connection between the sub-tank 151 and the main tank 141 is provided.

Once the liquid level detection unit 151*a* detects that ink inside the sub-tank 151 is less than the certain amount, the ink supply control unit 209 (FIG. 2) closes the atmosphere release valve V0, a supply valve V2, a collection valve V4, and a head replacement valve V5. Further, the ink supply control unit 209 opens the tank supply valve V1. In this state, the ink supply control unit 209 causes the vacuum pump P0 to operate. Then, the inside of the sub-tank 151 is to have a negative pressure and ink is supplied from the main tank 141 to the sub-tank 151. If the liquid level detection unit 151*a* detects that the amount of ink inside the sub-tank 151 is more than the certain amount, the ink supply control unit 209 closes the tank supply valve V1 to stop the vacuum pump P0.

The supply flow path C2 is a flow path for supplying ink from the sub-tank 151 to the print head 8, and a supply pump P1 and the supply valve V2 are arranged in the midstream of the supply flow path C2. During print operation, driving the supply pump P1 in the state of the supply valve V2 being open allows ink circulation in the circulation path while supplying ink to the print head 8. The amount of ink to be ejected per unit time by the print head 8 varies according to image data. A flow rate set for the supply pump P1 is determined so as to be adaptable even in a case where the print head 8 performs ejection operation in which ink consumption amount per unit time becomes maximum.

A relief flow path C3 is a flow path which is located in the upstream of the supply valve V2 and which connects between the upstream and downstream of the supply pump P1. In the midstream of the relief flow path C3, a relief valve V3 which is a differential pressure valve is provided. The relief valve V3 is not opened/closed by a driving mechanism but spring biased, and is configured to open if pressure reaches a predetermined level. For example, in a case where an amount of ink supply from the supply pump P1 per unit time is larger than the total value of an ejection amount of the print head 8 per unit time and a flow amount (ink drawing amount) in a collection pump P2 per unit time, the relief valve V3 is released according to a pressure applied to its own. As a result, a cyclic flow path composed of a portion of the supply flow path C2 and the relief flow path C3 is formed. By providing the configuration of the above relief flow path C3, the amount of ink supply to the print head 8 is adjusted according to the ink consumption amount by the print head 8 so as to stabilize a pressure inside the circulation path irrespective of the image data.

The collection flow path C4 is a flow path for collecting ink from the print head 8 to the sub-tank 151. In the midstream of the collection flow path C4, the collection pump P2 and the collection valve V4 are provided. At the time of ink circulation within the circulation path, the collection pump P2 sucks ink from the print head 8 by serving as a negative pressure generating source. By driving the collection pump P2, an appropriate differential pressure is generated between an IN flow path 80*b* and an OUT flow path 80*c* inside the print head 8, thereby causing ink to circulate from the IN flow path 80*b* to the OUT flow path 80*c*.

The collection valve V4 is a valve for preventing a backflow at the time of not performing print operation, that is, at the time of not circulating ink within the circulation path. In the circulation path of the present embodiment, the sub-tank 151 is disposed higher than the print head 8 in a vertical direction (see FIG. 1). For this reason, in a case where the supply pump P1 and the collection pump P2 are not driven, there may be a possibility that ink flows back from the sub-tank 151 to the print head 8 due to a water head difference between the sub-tank 151 and the print head 8. In order to prevent such a backflow, the present embodiment provides the collection valve V4 in the collection flow path C4.

Incidentally, at the time of not performing print operation, that is, at the time of not circulating ink within the circulation path, the supply valve V2 also functions as a valve for preventing ink supply from the sub-tank 151 to the print head 8.

A head replacement flow path C5 is a flow path connecting the supply flow path C2 and an air chamber (a space in which ink is not contained) of the sub-tank 151, and in the midstream of the head replacement flow path C5, the head replacement valve V5 is provided. One end of the head replacement flow path C5 is connected to the upstream of the print head 8 in the supply flow path C2 and connected downstream of the supply valve V2. The other end of the head replacement flow path C5 is connected to the upper part of the sub-tank 151 and is communicated with the air chamber inside the sub-tank 151. The head replacement flow path C5 is used in the case of drawing ink out of the print head 8 in use such as upon replacing the print head 8 or transporting the printing apparatus 1. The head replacement valve V5 is controlled by the ink supply control unit 209 so as to be closed except for a case of filling ink into the print head 8 and a case of collecting ink from the print head 8.

Next, a flow path configuration inside the print head 8 will be described. Ink supplied from the supply flow path C2 to the print head 8 passes through a filter 83 and then is supplied to a first negative pressure control unit 81 and a second negative pressure control unit 82. The first negative pressure control unit 81 is set to have a control pressure of a low negative pressure (a negative pressure with a small pressure difference from an atmospheric pressure). The second negative pressure control unit 82 is set to have a control pressure of a high negative pressure (a negative pressure with a large pressure difference from an atmospheric pressure). Pressures in the first negative pressure control unit 81 and second negative pressure control unit 82 are generated within a proper range by the driving of the collection pump P2.

In an ink ejection unit 80, a printing element substrate 80*a* in which a plurality of ejection openings are arrayed is arranged in plural to form an elongate ejection opening array. A common supply flow path 80*b* (IN flow path) for guiding ink supplied from the first negative pressure control unit 81 and a common collection flow path 80*c* (OUT flow path) for guiding ink supplied from the second negative pressure control unit 82 also extend in an arranging direction of the printing element substrates 80*a*. Furthermore, in the individual printing element substrates 80*a*, individual supply flow paths connected to the common supply flow path 80*b* and individual collection flow paths connected to the common collection flow path 80*c* are formed. Accordingly, in each of the printing element substrates 80*a*, an ink flow is generated such that ink flows in from the common supply flow path 80*b* which has a relatively lower negative pressure and flows out to the common collection flow path 80*c* which has a relatively higher negative pressure. In the midstream of a path between the individual supply flow path and the individual collection flow path, pressure chambers each of which is communicated with each ejection opening and filled with ink are provided. An ink flow is generated in the ejection opening and the pressure chamber even in a case where printing is not performed. Once the ejection operation is performed in the printing element substrate 80*a*, a part of ink moving from the common supply flow path 80*b* to the common collection flow path 80*c* is ejected from the ejection openings and is consumed. Meanwhile, ink not having been ejected moves toward the collection flow path C4 via the common collection flow path 80*c*.

Figure 10:
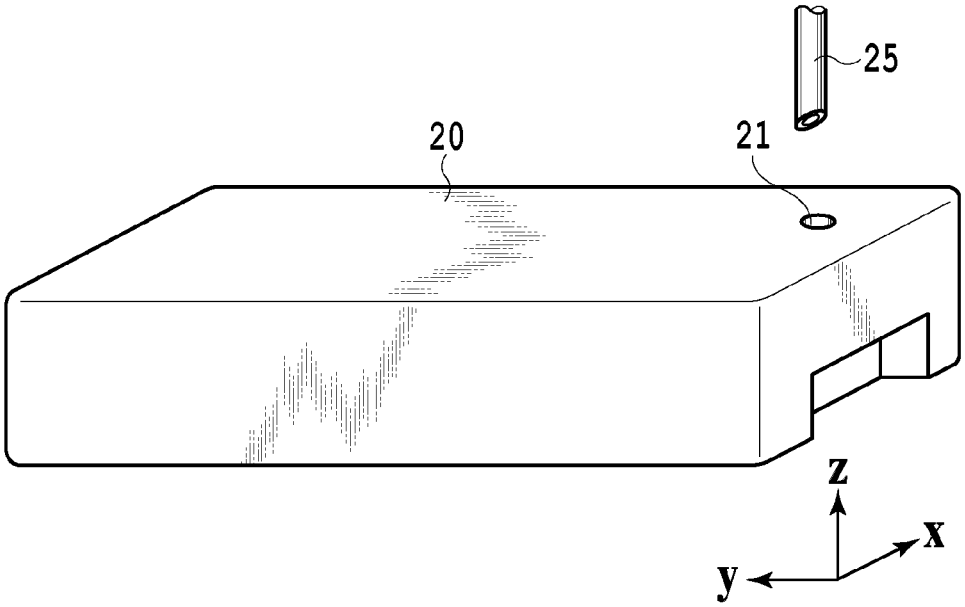
FIG. 10 is a perspective view of the appearance of a waste ink tank.

FIG. 10 is a perspective view of the appearance of the waste ink tank 20. On a top surface (a surface in a +z-direction side) of the waste ink tank 20 substantially forming a rectangular parallelepiped, an opening 21 is provided for the connection with a discharge joint 25 provided on an end of the tube. The waste ink tank 20 is installed by being inserted into the apparatus from the front side of the apparatus in the +y-direction. Once the installation is confirmed, the discharge joint 25 comes down from above and is connected with the opening 21 of the waste ink tank 20.

Figure 11A:
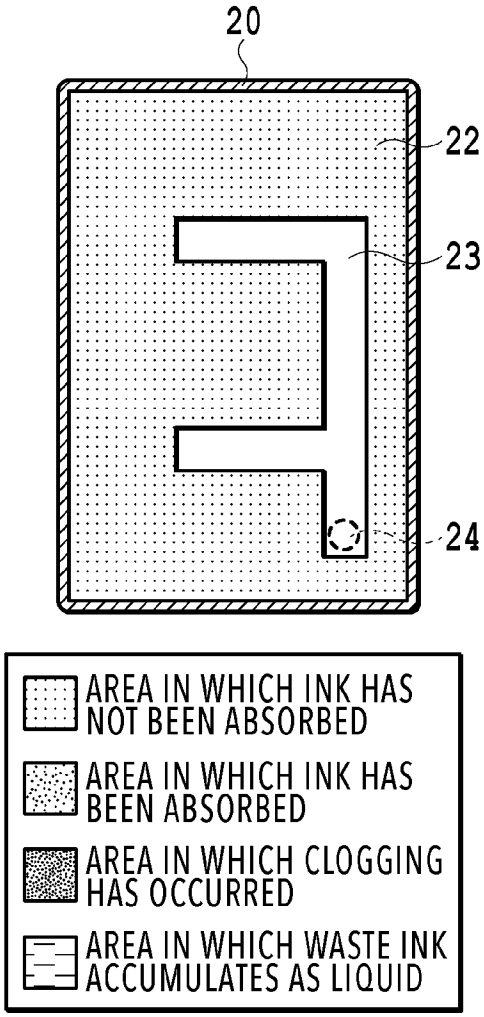
FIGS. 11A to 11C are diagrams showing a situation of waste ink permeating through an absorber.
Figure 11B:
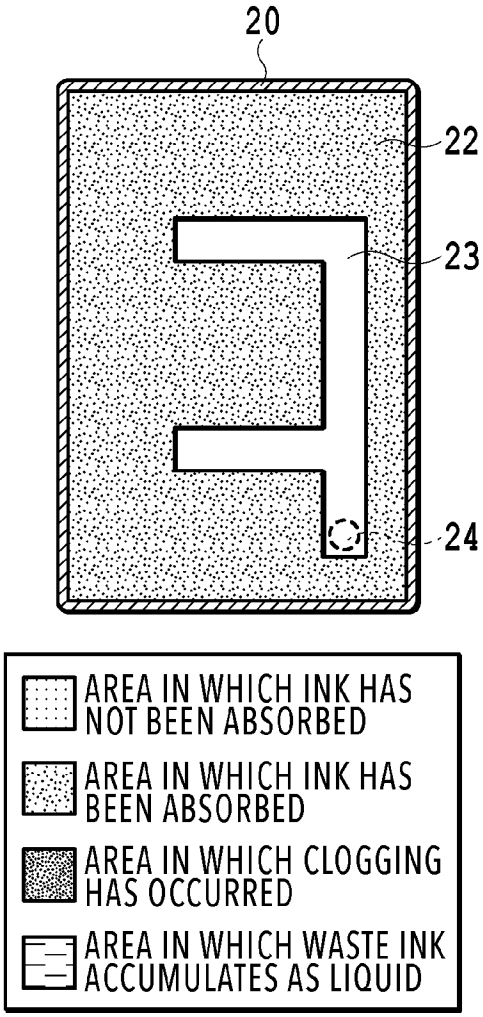
Figure 11C:
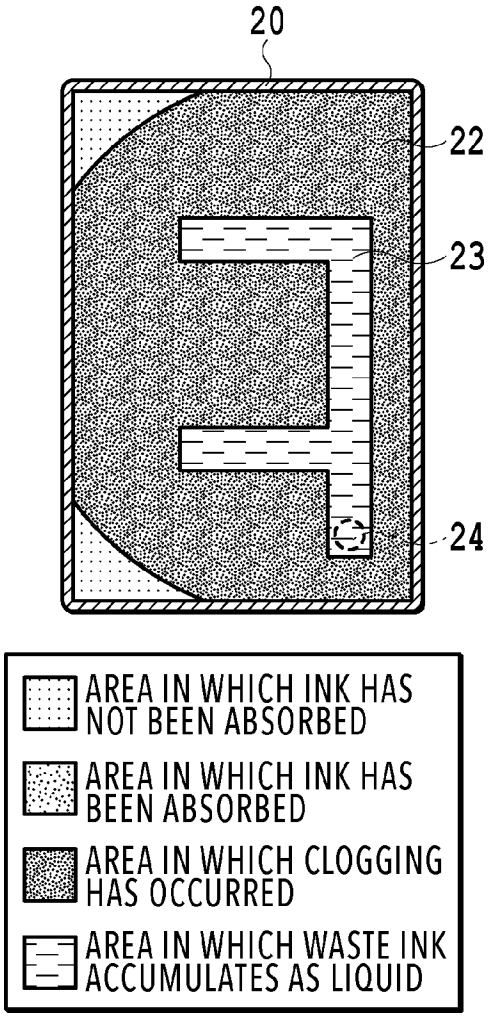

FIGS. 11A to 11C are diagrams showing a situation of waste ink permeating through an absorber 22 housed inside the waste ink tank 20. FIG. 11A is a diagram showing a situation before the waste ink is absorbed. The absorber 22 is housed inside the waste ink tank 20, and a guiding path 23 is formed in the absorber 22 such that part of the absorber 22 is hollowed out. The opening 21 is located in an end portion of the guiding path 23, and a dropping space 24 into which waste ink is dropped from the discharge joint 25 is formed in a corresponding position of the opening 21. Making the guiding path 23 long and manifold allows a larger area of the absorber 22 to contact the waste ink dropped into the dropping space 24 and can facilitate absorption of the waste ink into the absorber 22. For example, even if the waste ink dropped into the dropping space 24 cannot be further absorbed into the portion of the absorber 22 near the dropping space 24, the waste ink can be absorbed into a portion of the absorber 22 to which the waste ink is guided through the guiding path 23.

FIG. 11B shows a situation in which the dropped waste ink, which has evaporated to some extent, is preferably guided through the guiding path 23 and absorbed into the almost entire area of the absorber 22.

Meanwhile, FIG. 11C shows a situation in which evaporation of the waste ink absorbed into the portion near the guiding path 23 has advanced and the ink has thickened before the waste ink diffuses into the entire area of the absorber 22, and clogging has occurred in the absorber 22. In this case, the waste ink that has caused the clogging prevents the waste ink newly dropped into the dropping space 24 from permeating, and thus unabsorbed waste ink is accumulated in the guiding path 23. In addition, some areas of the absorber 22 do not absorb ink because the waste ink does not permeate due to the clogging.

In other words, even in a case where a total waste ink amount contained in the waste ink tank 20 has not reached an absorbable amount in the entire area of the absorber 22, the waste ink may not be further absorbed into the absorber 22 because of the clogging, and the waste ink may leak out of the opening 21 if the waste ink accumulated in the guiding path 23 exceeds the absorbable amount. Further, it is known that thickening and adhering of the waste ink advance as the evaporation of the waste ink proceeds, and the evaporation of the waste ink depends on a time elapsed from the discharge of the waste ink into the waste ink tank 20, an environment temperature, an environment humidity, and the like.

Therefore, in the present embodiment, based on a time elapsed from the discharge of the waste ink, an environment temperature, and an environment humidity, an evaporation rate of the waste ink contained in the waste ink tank is acquired, and a threshold for determining whether the waste ink tank has reached its full capacity is set according to the acquired evaporation rate.

Figure 12:
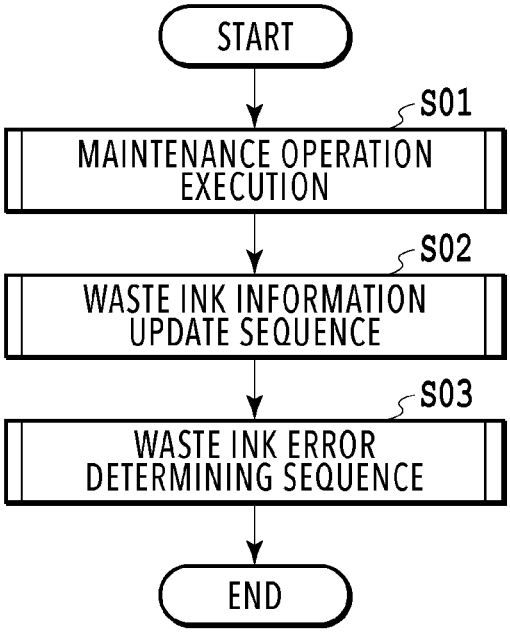
FIG. 12 is a flowchart in a case where maintenance operation is performed.

FIG. 12 is a flowchart for explaining a sequence of steps performed in a case where the print controller 202 performs maintenance operation on the print head 8 in the inkjet printing apparatus according to the present embodiment. The present process is performed according to a user instruction via the operating panel 104 and also in a case where the print controller 202 determines that maintenance of the print head 8 is needed based on various conditions.

Once the present process is started, the print controller 202 performs a predetermined maintenance operation in S01. In S01, various kinds of maintenance operation are performed according to conditions, such as wiping processes described with reference to FIGS. 8A and 8B, multiple suction operations with various suction amounts, and multiple preliminary ejection operations with the number of ejections different for each ink color.

In S02, the print controller 202 performs a waste ink information update sequence for updating waste ink information based on the type of maintenance operation performed in S01.

Figure 13:
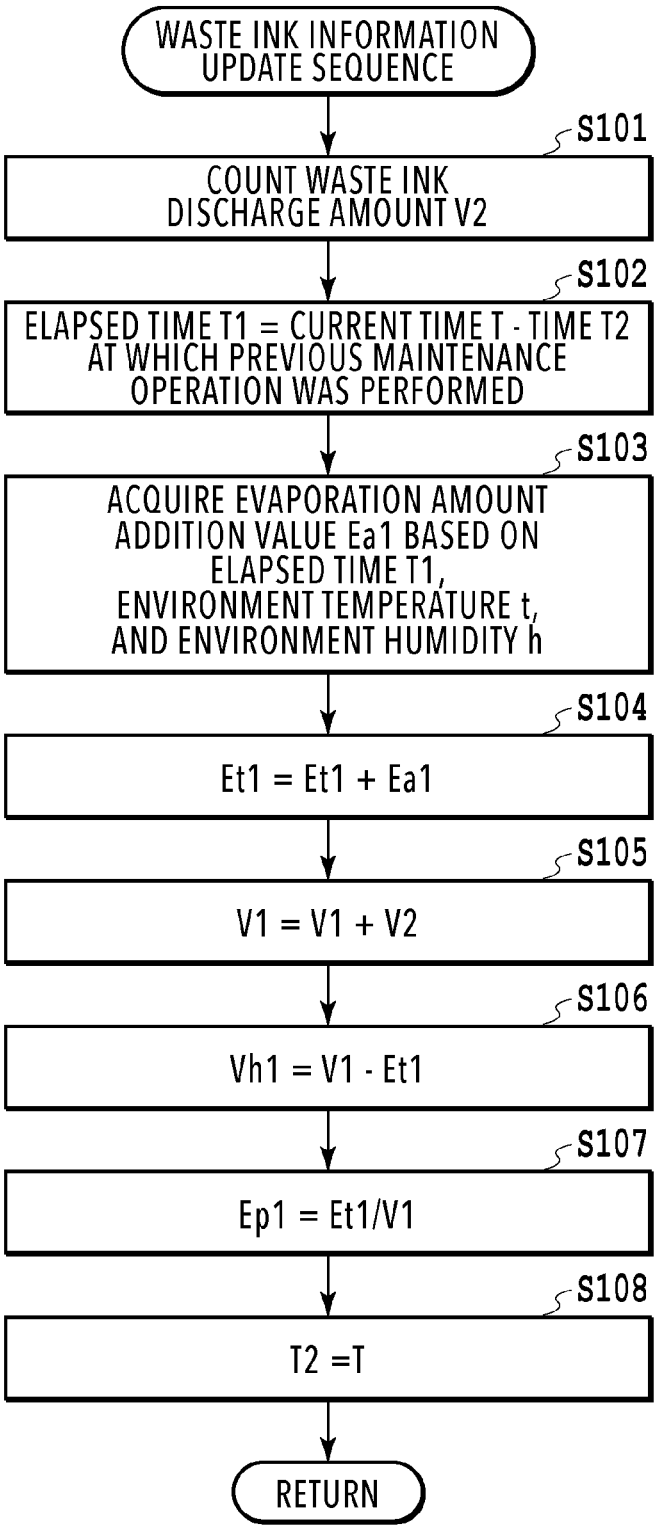
FIG. 13 is a flowchart of a waste ink information update sequence.

FIG. 13 is a flowchart for explaining process steps of the waste ink information update sequence performed in S02. Once the present process is started, first in S101, the print controller 202 counts a waste ink discharge amount V2 discharged into the waste ink tank 20 through the maintenance operation performed in S01. More specifically, with reference to a table storing the maintenance operation and the waste ink discharge amount V2 that are associated with each other in advance, a waste ink discharge amount associated with the maintenance operation performed in S01 is acquired.

In S102, the print controller 202 acquires an elapsed time T1 between the times when the previous maintenance operation was performed and when the maintenance operation this time is performed, by using the timer that the maintenance control unit 210 manages. It should be noted that the timer measures a time elapsed from the installation of the waste ink tank in the apparatus and is reset every time the waste ink tank is replaced.

The print controller 202 calculates the elapsed time T1 by subtracting a time T2 at which the previous maintenance operation was performed (the last maintenance time) from a current time T indicated by the timer. In a case where the maintenance operation performed this time is a first maintenance operation after the installation of the currently used waste ink tank 20, the elapsed time T1 is set at an initial value 0 (T=0).

In S103, the print controller 202 acquires an evaporation amount addition value Ea1 based on the elapsed time T1 acquired in S102, an environment temperature t, and an environment humidity h. Note that the environment temperature t and the environment humidity h are detected by a temperature sensor and a humidity sensor placed in the apparatus, respectively.

FIG. 14 is a table showing a waste ink evaporation amount Ea per unit time corresponding to the environment temperature t and the environment humidity h. The table stores a waste ink evaporation amount per unit time for each of the combinations of an environment temperature and an environment humidity, that is, a combination of an environment temperature of equal to or higher than 23° C. or an environment temperature of lower than 23° C. and an environment humidity of equal to or higher than 50% or an environment humidity of lower than 50%. In the present embodiment, such a table is stored in advance in the ROM 201 of the print engine unit 200.

In S103 of FIG. 13, with reference to the evaporation amount table shown in FIG. 14, the print controller 202 acquires a unit time evaporation amount Ea corresponding to the detected combination of the environment temperature t and the environment humidity h. Then, by adding the unit time evaporation amount Ea to the elapsed time T1 acquired in S102, the print controller 202 calculates an evaporation amount addition value Ea1. The evaporation amount addition value Ea1 may be considered as an amount of ink that has evaporated from the waste ink tank 20 since the previous maintenance process was performed and before the maintenance process this time is performed.

In S104, the print controller 202 adds the evaporation amount addition value Ea1 to a total evaporation amount Et1 that has already been stored. The total evaporation amount Et1 corresponds to an amount of waste ink that has evaporated from the waste ink tank since the first maintenance operation was performed after the installation of the currently used waste ink tank 20 and before the last maintenance operation at this point is performed. Accordingly, an initial value of the total evaporation amount Et1 is 0, and the total evaporation amount Et1 is updated in S104 every time a new maintenance operation is performed.

In S105, the print controller 202 adds the waste ink discharge amount V2 acquired in S101 to the total waste ink amount V1 that has already been stored and acquires a new total waste ink amount V1.

In S106, the print controller 202 subtracts the total evaporation amount Et1 updated in S104 from the total waste ink amount V1 updated in S105 to acquire a waste ink retention amount Vh1. The waste ink retention amount Vh1 may be considered as an amount of waste ink actually retained (an amount of absorbed waste ink) in the absorber 22 of the waste ink tank 20 at this point.

In S107, the print controller 202 divides the total waste ink amount V1 updated in S105 by the total evaporation amount Et1 updated in S104 to acquire a waste ink evaporation rate Ep1. The waste ink evaporation rate Ep1 is a value indicating a level of evaporation of the waste ink actually retained in the absorber 22 of the waste ink tank 20 at this point. That is, as the waste ink evaporation rate Ep1 increases, thickening and adhering of the waste ink advance, and it can be assumed that it is difficult for the waste ink to diffuse in the absorber 22.

In S108, the print controller 202 overwrites the current time T as a last maintenance time T2 (T2=T). As above described, the waste ink information update sequence is finished.

Figure 15A:
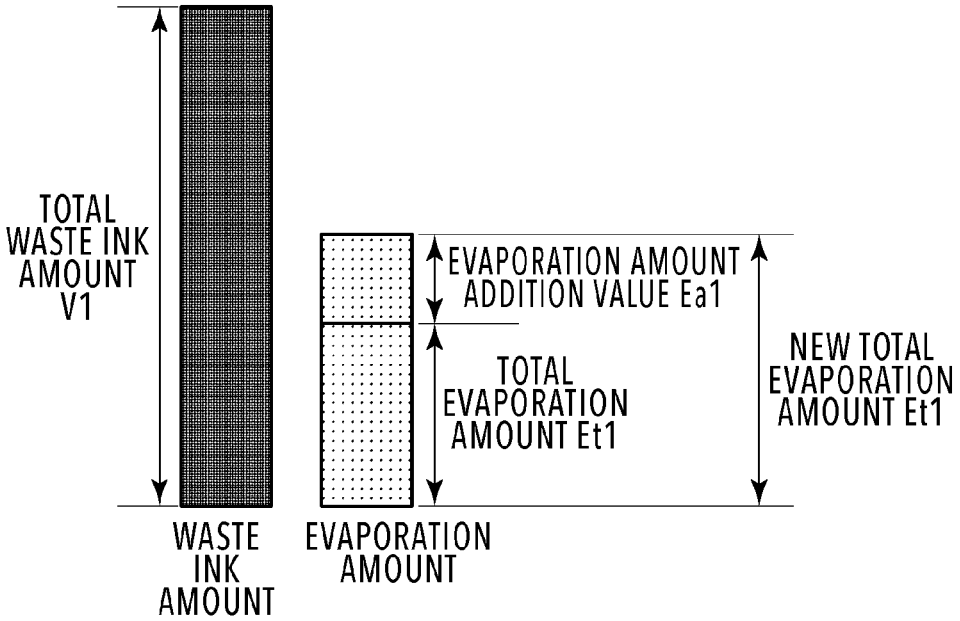
FIGS. 15A to 15C are diagrams showing a relation between a waste ink amount and an evaporation amount.
Figure 15B:
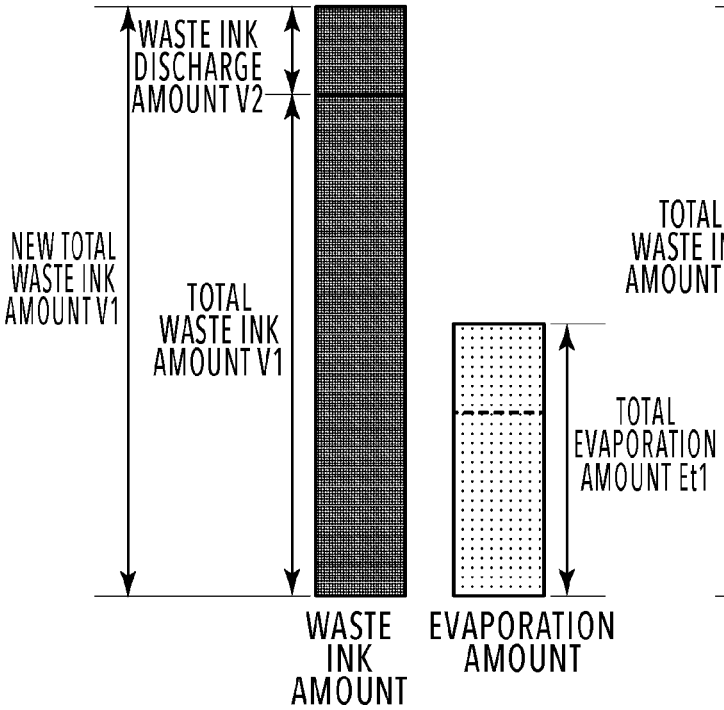
Figure 15C:
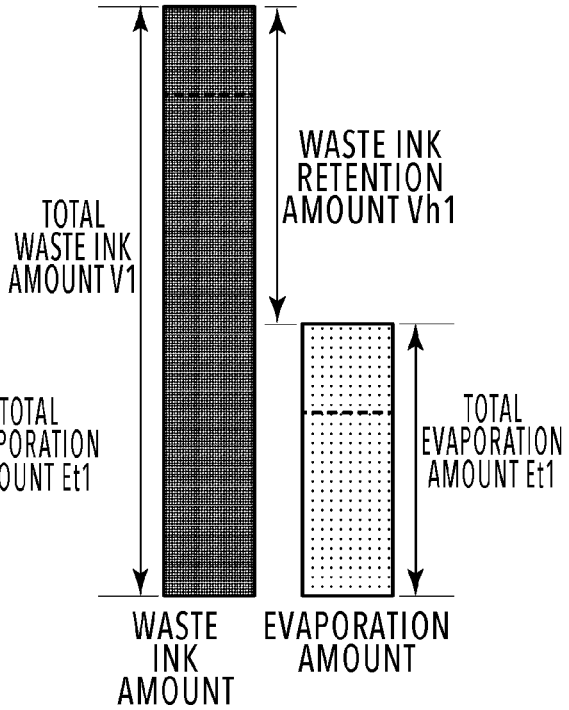

FIGS. 15A to 15C are diagrams showing a relation between a waste ink amount discharged into the waste ink tank and an evaporation amount. FIG. 15A shows a situation in which a new total evaporation amount Et1 is obtained by adding the evaporation amount addition value Ea1 to the total evaporation amount Et1 in S104. FIG. 15B shows a situation in which a new total waste ink amount V1 is obtained by adding the waste ink discharge amount V2 to the total waste ink amount V1 in S105. FIG. 15C shows a situation in which a waste ink retention amount Vh1 (an amount of waste ink retained in the absorber 22 at this point) is obtained by subtracting the updated total evaporation amount Et1 from the updated total waste ink amount V1 in S106. The print controller 202 updates the total waste ink amount V1, the total evaporation amount Et1, and the waste ink retention amount Vh1 in S104, S105, and S106 every time a new maintenance operation is performed and stores them in the RAM 204.

Referring back to the flowchart of FIG. 12. After the waste ink information update sequence in S02 is finished, the print controller 202 performs a waste ink error determining sequence in S03.

Figure 16:
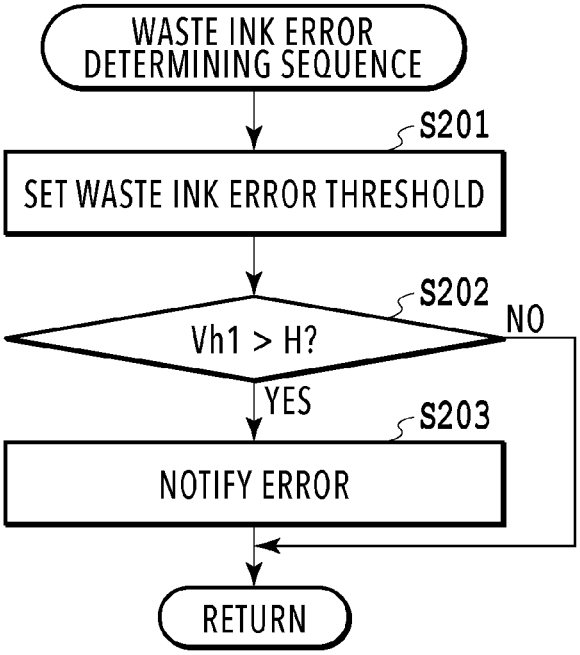
FIG. 16 is a flowchart of a waste ink error determining sequence.

FIG. 16 is a flowchart for explaining process steps of the waste ink error determining sequence performed in S03. Once the present process is started, first in S201, the print controller 202 sets a waste ink error threshold H based on the waste ink evaporation rate Ep1 acquired in S107 of FIG. 13.

FIG. 17 shows a table to which the print controller 202 refers in the threshold setting step in S201. The table stores a correspondence between the waste ink evaporation rate Ep1 and the waste ink error threshold H. In the present embodiment, the waste ink error threshold H is 550 g if the waste ink evaporation rate Ep1 is equal to or higher than 50%. Further, the waste ink error threshold H is 650 g if the waste ink evaporation rate Ep1 is lower than 50%. In this manner, the waste ink evaporation rate Ep1 and the waste ink error threshold H are associated with each other such that as the waste ink evaporation rate Ep1 increases, the waste ink error threshold H is set at a smaller value. In other words, as the waste ink evaporation rate Ep1 increases, a waste ink error may be notified to a user at an earlier timing. In the present embodiment, such a table is stored in advance in the ROM 201 of the print engine unit 200.

Referring back to the flowchart of FIG. 16. In S202, the print controller 202 compares the waste ink retention amount Vh1 acquired in S106 of FIG. 13 and the waste ink error threshold H acquired in S201. In a case where the waste ink retention amount Vh1 exceeds the waste ink error threshold H, the print controller 202 proceeds to S203 and performs a waste ink error notification process. More specifically, via the operating panel 104 (see FIG. 2), the print controller 202 notifies the full capacity of the waste ink tank to the user and prompts the user to replace the waste ink tank 20 and the like.

Meanwhile, in S202, in a case where it is determined that the waste ink retention amount Vh1 is equal to or less than the waste ink error threshold H, the print controller 202 skips S203. Then, the waste ink error determining sequence shown in FIG. 16 is finished and the sequence of processes involving the maintenance operation shown in FIG. 12 is also completed.

According to the above-described present embodiment, in a case where the waste ink evaporation rate Ep1 is high, the waste ink error threshold H is set at a smaller value, and thus a waste ink error is easily determined even in a case where the total waste ink amount V1 is smaller than an absorbable capacity of the absorber. As a result, even if diffusion of the waste ink is hindered by the adhering ink, ink leakage of the waste ink tank can be prevented.

Second Embodiment

The level of thickening and adhering of waste ink in the waste ink tank 20 depends on the type of ink as well as the above-described elapsed time, environment temperature, and environment humidity. For example, pigment ink tends to thicken as compared to dye ink. Furthermore, different types of dye ink may have different levels of thickening depending on the type (color) of color material. In the present embodiment, the print head 8 can eject four colors of ink: cyan, magenta, and yellow chromatic color ink and black ink. The black ink tends to thicken as compared to the other chromatic color ink. Accordingly, in the present embodiment, as the ratio of the black ink to the waste ink increases, the waste ink error threshold H is set at a smaller value.

Also in the present embodiment, like the first embodiment, the inkjet printing apparatus described with reference to FIG. 1 to FIG. 9 is used. In a case where maintenance operation is performed, basically a sequence of processes is performed in accordance with the flowcharts shown in FIG. 12, FIG. 13, and FIG. 16.

Note that in S101 of FIG. 13, the print controller 202 counts the waste ink discharge amount V2 for each ink color. Then, not only a total waste ink amount V1 and a waste ink retention amount Vh1, but also a ratio of black ink included in these amounts is calculated, and they are updated every time maintenance operation is performed.

FIG. 18 shows a table to which the print controller of the present embodiment refers in S201 of FIG. 16. The table stores the waste ink error threshold H in a case where the waste ink evaporation rate Ep1 is equal to or greater than 50% or the waste ink evaporation rate Ep1 is less than 50% and a case where the ratio of black ink to the waste ink retention amount Vh1 is equal to or greater than 70% or the ratio of black ink to the waste ink retention amount Vh1 is less than 70%. Provided that the waste ink evaporation rate Ep1 is equal to or greater than 50%, a smaller waste ink error threshold H is set in a case where the ratio of black ink to the waste ink is equal to or greater than 70%, as compared to a case where the ratio of black ink to the waste ink is less than 70%.

Note that the value (70%) indicated herein is an example. A first threshold may be set as a waste ink error threshold in a case where the ratio of black ink is equal to or greater than a predetermined value and a second threshold that is smaller than the first threshold may be set in a case where the ratio of black ink is less than a predetermined value.

As described above, according to the present embodiment, in a case where the ratio of black ink to the waste ink is great, the waste ink error threshold H is set at a smaller value as compared to the case where the ratio of black ink to the waste ink is small. As a result, in a situation in which a greater amount of black ink that easily thickens is discharged, a waste ink error is determined at an earlier timing, and it is possible to prevent ink leakage of the waste ink tank.

Third Embodiment

In the ink supply system described with reference to FIG. 9, ink evaporation may advance as the circulating time between the sub-tank 151 and the print head 8 becomes longer and ink may thicken. In such a case, evaporation of the waste ink discharged to the waste ink tank 20 has already advanced, and the waste ink tends to thicken and adhere at a relatively early stage in the absorber 22. Accordingly, in the present embodiment, a level of ink density (hereinafter referred to as an ink density) in the circulation path is acquired. As the ink density increases, a smaller waste ink error threshold H is set so that the waste ink error notification process is performed at an earlier timing.

Also in the present embodiment, like the first embodiment, the inkjet printing apparatus as described with reference to FIG. 1 to FIG. 9 is used. In a case where maintenance operation is performed, basically a sequence of processes is performed in accordance with the flowcharts shown in FIG. 12, FIG. 13, and FIG. 16. Furthermore, the print controller 202 of the present embodiment appropriately acquires information on an ink density D in the circulation path.

Now, density information D will be simply explained. In the present embodiment, the density information D is an estimate value of the level of concentration of ink circulating in the ink supply system described with reference to FIG. 9, and may be expressed by the following equation:

$$DX+1=(DX\times(Jn-In))\div(Jn-In-V).$$

As used herein, DX+1 represents a density after print operation and DX represents a density before print operation. Further, Jn represents an ink amount in a circulation system before print operation, In represents an ink amount ejected through print operation, and V represents an evaporation amount from the circulation system.

In the present embodiment, as for the density information D, a value calculated based on the above equation is stored in the ROM 203. Every time the print operation (print job) is performed, the print controller 202 retrieves density information D (DX) stored when the previous print operation was performed, calculates density information DX+1 based on the above equation, and overwrites it as new density information D.

Furthermore, the density information is managed for each ink supply system, that is, for each ink color, and the print controller calculates an overall ink density D according to an average value of the density information D for each color or a predetermined operation expression.

FIG. 19 shows a table to which the print controller of the present embodiment refers in S201 of FIG. 16. The table stores the waste ink error threshold H in a case where the waste ink evaporation rate Ep1 is equal to or greater than 50% or the waste ink evaporation rate Ep1 is less than 50% and a case where the ink density D in the ink circulation path is equal to or greater than 0.0632 or the ink density Din the ink circulation path is less than 0.0632. Even at the same waste ink evaporation rate Ep1, a waste ink error threshold H is smaller in a case where the ink density D in the ink circulation path is equal to or greater than 0.0632 as compared to the case where the ink density D in the ink circulation path is less than 0.0632.

As described above, according to the present embodiment, in a case where the ink density D in the ink circulation path is great, the waste ink error threshold H is set at a small value as compared to the case where the ink density D in the ink circulation path is small. As a result, in a situation in which evaporation of ink in the ink circulation path has already advanced, a waste ink error is determined at an earlier timing, and it is possible to prevent ink leakage of the waste ink tank.

It should be noted that in the above-described embodiments, a waste ink error threshold H is prepared for each of the two different waste ink evaporation rates: a case where a waste ink evaporation rate Ep1 is less than 50% and a case where a waste ink evaporation rate Ep1 is equal to or greater than 50%. However, a waste ink error threshold H may be set for each of three or more waste ink evaporation rates Ep1. In any case, a waste ink evaporation rate Ep1 and a waste ink error threshold H may be associated with each other such that as a waste ink evaporation rate Ep1 increases, a waste ink error threshold H becomes smaller. Accordingly, the effect of the present invention can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189619 filed Oct. 5, 2018, which is hereby incorporated by reference wherein in its entirety.

What is claimed is:

1. A control method for an inkjet printing apparatus that includes a waste ink tank having an absorber that absorbs ink discharged from a print head that ejects ink, the control method comprising:

counting a waste ink amount discharged to the waste ink tank;

measuring an elapsed time from the discharge of the waste ink into the waste ink tank;

acquiring a waste ink retention amount by obtaining an evaporation amount of waste ink retained in the waste ink tank based on the elapsed time and subtracting the evaporation amount from the waste ink amount;

acquiring a waste ink evaporation rate which is calculated by using the evaporation amount and the waste ink amount;

setting a threshold based on the calculated waste ink evaporation rate; and determining whether the waste ink retention amount does or does not exceed the threshold.

2. The control method according to claim 1, further comprising making a notification that the waste ink tank must be replaced in a case when the waste ink retention amount exceeds the threshold.

3. The control method according to claim 1, wherein the threshold which is set in the setting step in a case where the waste ink evaporation rate is a first value is smaller than the threshold which is set in the setting step in a case where the waste ink evaporation rate is a second value lower than the first value.

* * * * *